US006830457B1

(12) United States Patent
Korsunsky et al.

(10) Patent No.: US 6,830,457 B1
(45) Date of Patent: Dec. 14, 2004

(54) MULTI-FUNCTION PICK-UP CAP FOR ELECTRICAL CONNECTOR

(75) Inventors: Iosif R. Korsunsky, Harrisburg, PA (US); Brian J. Gillespie, Harrisburg, PA (US); Kevin E. Walker, Hershey, PA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/604,353

(22) Filed: Jul. 14, 2003

(51) Int. Cl.[7] ..... H01R 13/60; H01R 4/50; H01R 13/44

(52) U.S. Cl. ..... 439/41; 439/342; 439/135

(58) Field of Search ..... 439/41–42, 135, 439/342

(56) References Cited

U.S. PATENT DOCUMENTS 4,726,793 A * 2/1988 Bright ..... 439/751
5,026,295 A 6/1991 Fong et al. ..... 439/135
5,342,214 A * 8/1994 Hsu ..... 439/342
6,042,389 A 3/2000 Lemke et al. ..... 439/74
6,116,949 A 9/2000 Costello et al. ..... 439/509
6,164,983 A * 12/2000 Lemke et al. ..... 439/83
6,231,367 B1 * 5/2001 Hsiao et al. ..... 439/342
6,241,535 B1 6/2001 Lemke et al. ..... 439/83
6,371,776 B1 4/2002 Li et al. ..... 439/135
6,439,901 B1 8/2002 Ji et al. ..... 439/135
6,478,588 B1 * 11/2002 Howell et al. ..... 439/135
6,506,064 B1 1/2003 Wu ..... 439/135
6,554,624 B1 * 4/2003 Yu ..... 439/135
6,699,048 B2 * 3/2004 Johnson et al. ..... 439/74

* cited by examiner

*Primary Examiner*—Michael C. Zarroli
(74) *Attorney, Agent, or Firm*—Wei Te Chung

(57) ABSTRACT

An electrical connector assembly (1) the present invention includes an insulative housing (4), a number of contacts (2) received in the insulative housing, and a pick-up cap (3). Each contact includes a contacting portion (21) and a connecting portion (23) for being soldered to a printed circuit board. The pick-up cap is removably assembled to the insulative housing and retains and positions the contacts therein.

16 Claims, 10 Drawing Sheets

3

MULTI-FUNCTION PICK-UP CAP FOR ELECTRICAL CONNECTOR

CROSS REFERENCE TO RELATED APPLICATIONS

Relevant subject matter is disclosed in U.S. Patent Applications with Ser. Nos. 10/840,989 filed May 7, 2004 and entitled "ELECTRICAL CONNECTOR HAVING IMPROVED CONTACTS", and Ser. No. 10/602,247 entitled "ELECTRICAL CONNECTOR WITH IMPROVED CONTACT RETENTION" filed on Jun. 23, 2003, now U.S. Pat. No. 6,743,059, both of which are invented by the same inventor as this patent application and assigned to the same assignee with this application.

BACKGROUND OF INVENTION

1. Field of the Invention

The present invention generally relates to an electrical connector, and more particularly to a pick-up cap for an electrical connector.

2. Description of Related Art

Electrical connectors electrically connected to a printed circuit board often have through hole (T/H) or surface mount type contacts and are preferably placed at selected positions on the printed circuit board by pick-and-place apparatus. U.S. Pat. Nos. 5,026,295 and 6,116,949 disclose electrical connectors to which a cover or cap is mounted so that a suction nozzle of a suction apparatus can engage the cover or cap and, via suction pick-up, the electrical connectors and place them onto selected positions of a printed circuit board. The cover or cap is removed from the connectors after the contacts have been soldered to the printed circuit board.

With the rapid development of economy, high production efficiency is a primary aim of manufacturers all along. However, the electrical connectors disclosed above usually use tools or an operators fingers to insert electrical contacts to housings thereof, and then the cover or cap is assembled to the housings. This wastes time of assembling the connectors to the printed circuit board, thus, decreases the production efficiency. In addition, the cover or cap only engages with the housings of the electrical connectors, and the electrical contacts engage with the housing via retention barbs thereof. Therefore, the electrical contacts still have room to move between the cover or cap and the housing during being soldered to the printed circuit board. This inevitably influences electrical connection between the connectors and the printed circuit board.

Hence, a multi-function pick-up cap is needed to address the problems encountered in the related art.

SUMMARY OF INVENTION

An object of the present invention is to provide a multi-function pick-up cap used in an electrical connector for improving production efficiency.

Another object of the present invention is to provide an electrical connector assembly with a multi-function pick-up cap for achieving more reliable electrical connection with a printed circuitboard.

In order to achieve the objects set forth, OLE_LINK3 an electrical connector assembly in accordance with the present invention comprises an insulative housing, a plurality of contacts received in the insulative housing, and a pick-up cap. Each contact comprises a contacting portion and a connecting portion for being soldered to a printed circuit board. The pick-up cap is removably assembled to the insulative housing and retains and positions the contacts in the insulative housing.

Other objects, advantages and novel features of the invention will become more apparent from the following detailed description when taken in conjunction with the accompanying drawings.

DETAILED DESCRIPTION

Reference will now be made in detail to the preferred embodiment of the present invention.

Figure 8:
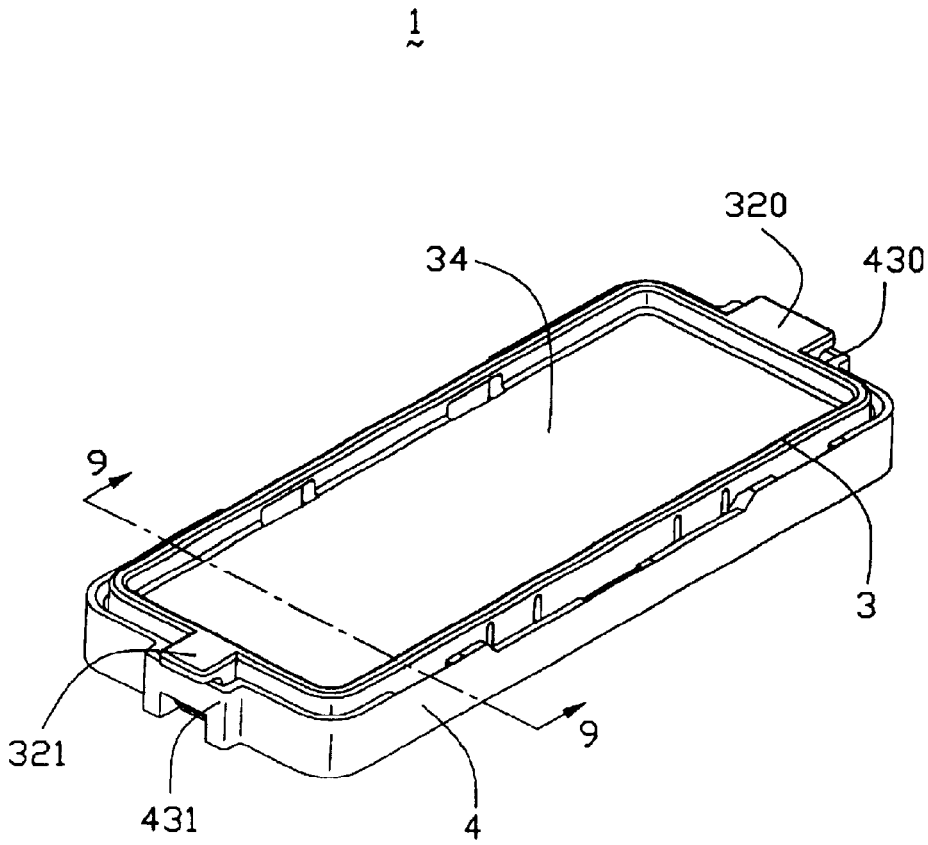
FIG. 8 is an assembled view of the electrical connector assembly in accordance with the present invention.
Figure 9:
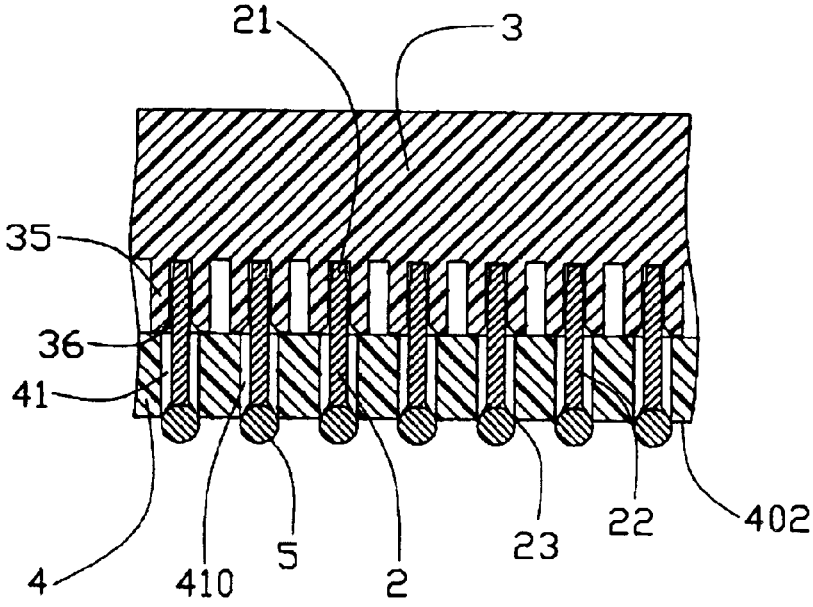
FIG. 9 is a partially cross-sectional view of the electrical connector assembly taken along line 9—9 of FIG. 8.
Figure 10:
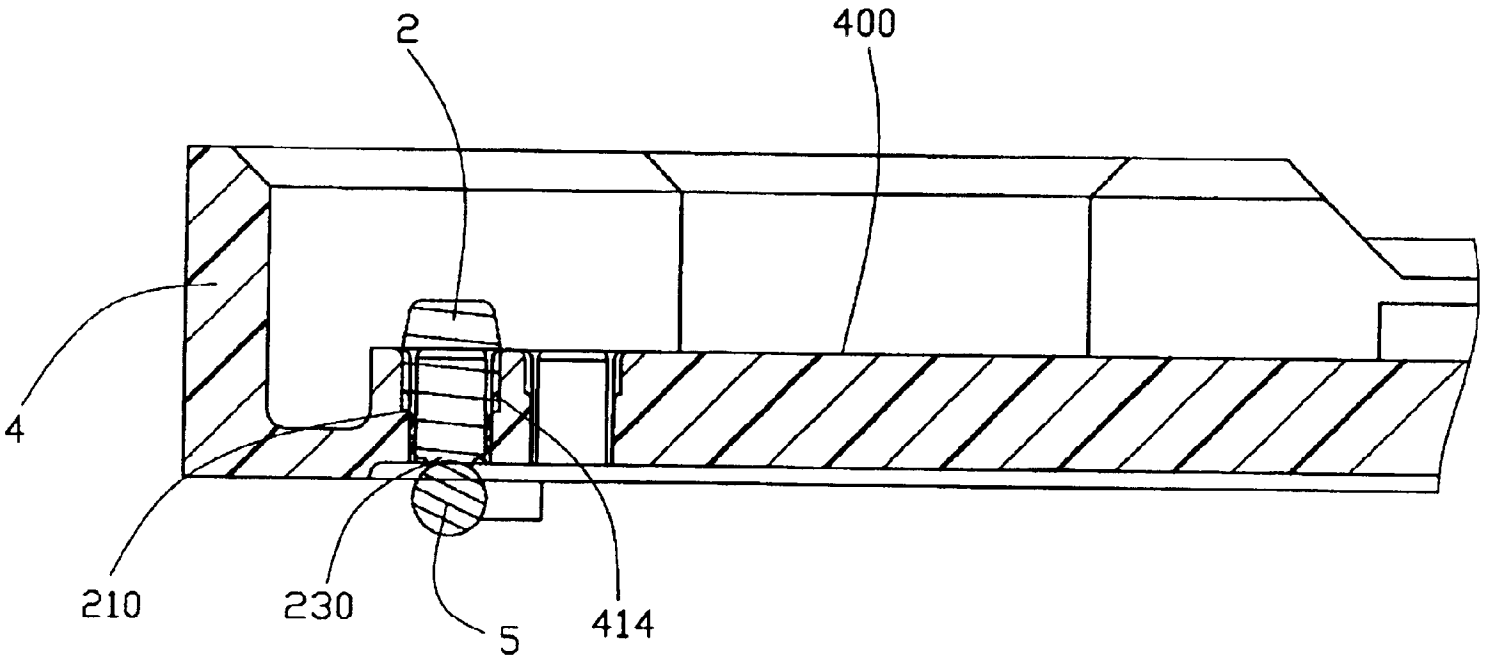
FIG. 10 is a partially cross-sectional view of the insulative housing taken along line 10—10 of FIG. 1, with one contact being assembled therein and illustrated by broken lines.

Referring to FIGS. 8–10, an electrical connector assembly 1 in accordance with the present invention comprises an insulative housing 4, an array of contacts 2 assembled to the insulative housing 4, and a pick-up cap 3.

Figure 1:
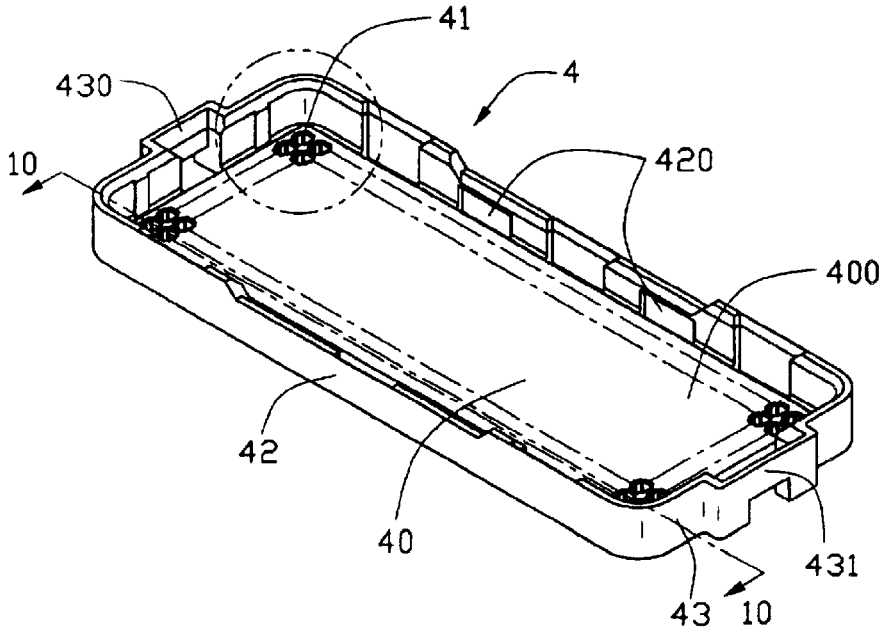
FIG. 1 is a perspective view of an insulative housing of an electrical connector assembly in accordance with the present invention.
Figure 2:
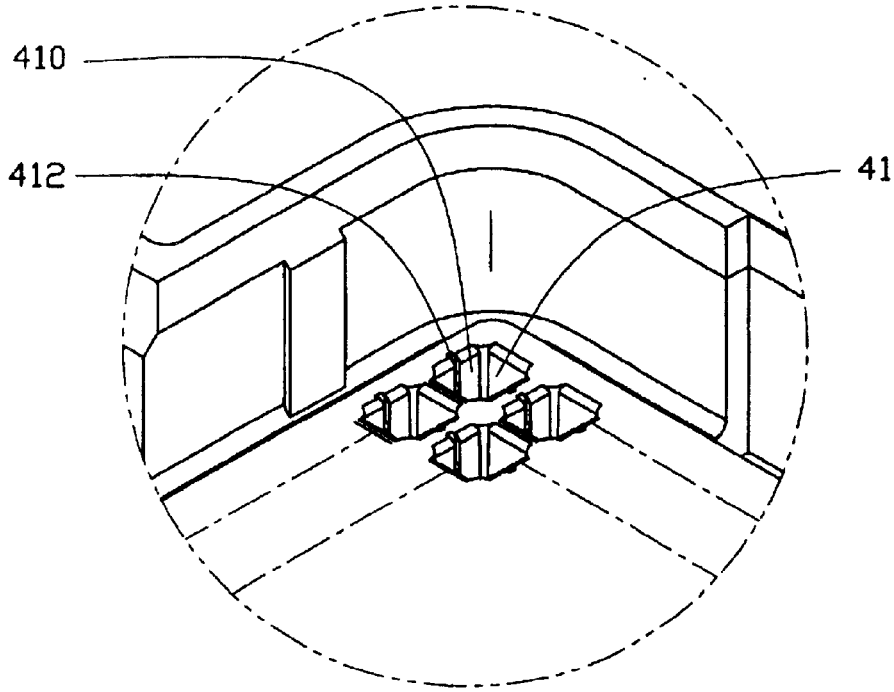
FIG. 2 is a partially enlarged view of the insulative housing of FIG. 1.

Referring to FIG. 1 and FIG. 2, the insulative housing 4 is of a substantially rectangular box shape and comprises a substantially planar base 40, a pair of longitudinal walls 42 and a pair of lateral walls 43 extending upwardly from periphery of the base 40. A first and a second polarizing tabs 430, 431 are respectively formed on the pair of opposite lateral walls 43 for properly mating with a complementary connector (not shown). A pair of recesses 420 is defined in each longitudinal wall 42. An array of passages 41 extend from a mating surface 400 toward a mounting surface 402 (referring to FIG. 9) of the base 40. A pair of opposite slots 412 is defined in a pair of opposite side surfaces 410 of the passage 41 and communicates with the passage 41. Thus, a step 414 (referring to FIG. 10) is formed in a middle of the passage 41.

Figure 3:
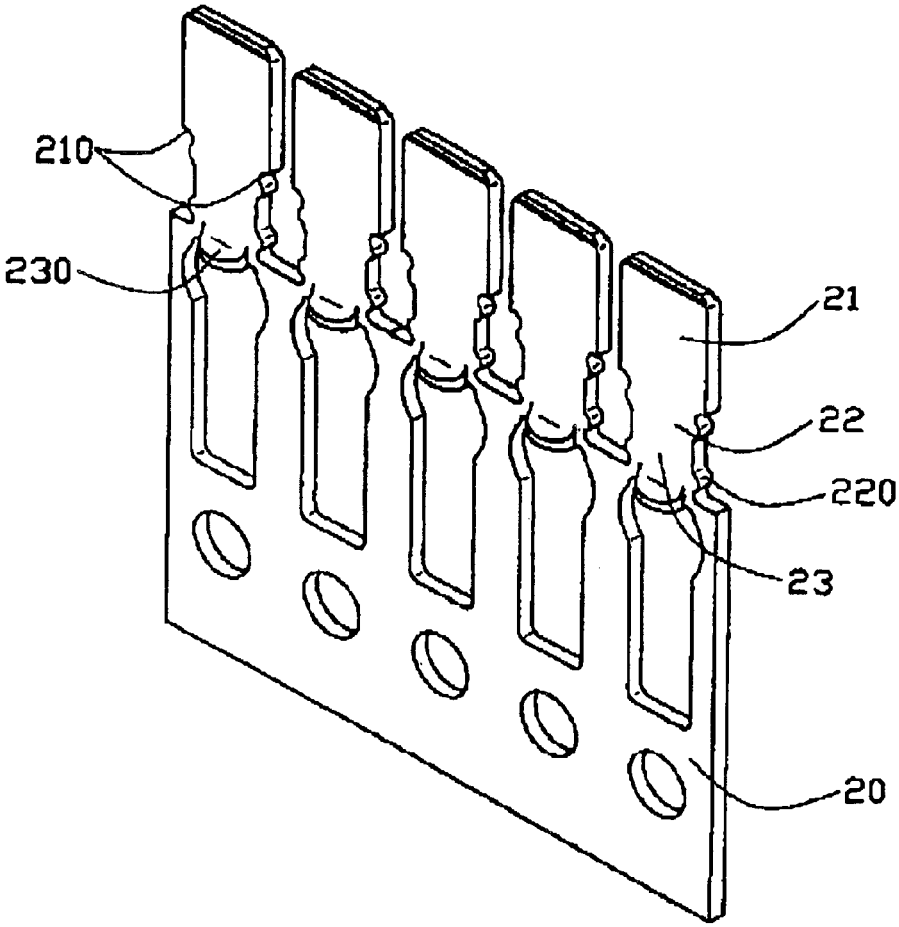
FIG. 3 is a perspective view of a plurality of contacts of the electrical connector assembly with a carrier thereon in accordance with the present invention.
Figure 4:
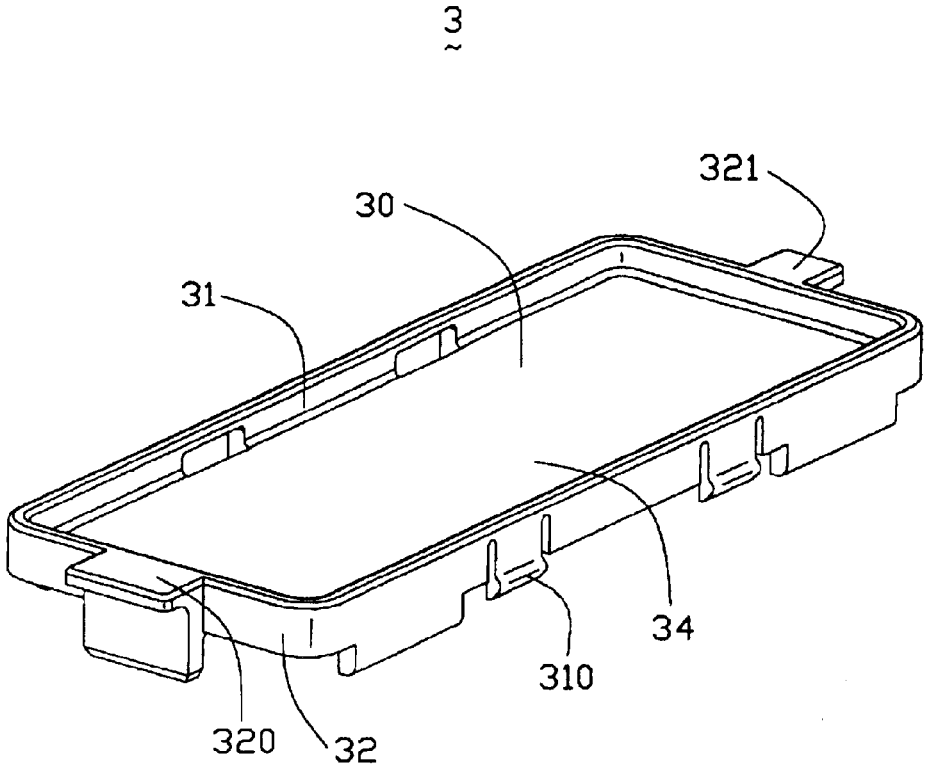
FIG. 4 is a perspective view of a pick-up cap in accordance with the present invention.
Figure 7:
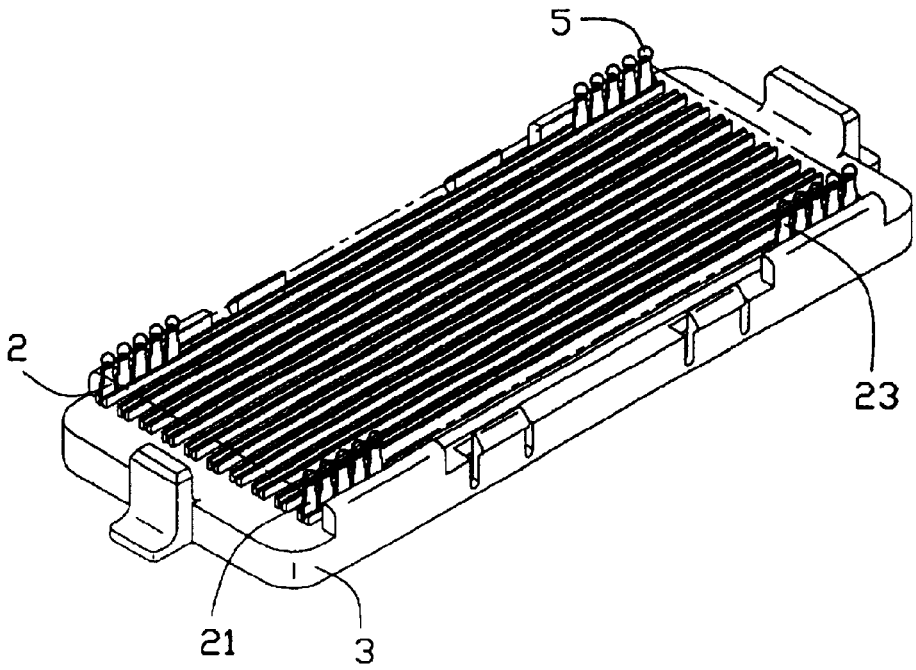
FIG. 7 is a view similar to FIG. 6, with the carriers being removed from the contacts and the solder balls on the contacts.

Referring to FIG. 3, each contact 2 comprises a flat contacting portion 21, a connecting portion 23 opposite to the contacting portion 21, and a retention portion 22 connecting the contacting portion 21 and the connecting portion 23. The retention portion 22 has a smaller width than the contacting portion 21, thus, a pair of shoulders 210 is formed on a rear edge of the contacting portion 21. A plurality of barbs 220 is formed on opposite sides of the retention portion 22. The connecting portion 23 includes a solder pad 230 to have a fusible substrate contact mass or body, such as a solder ball 5 (referring to FIG. 7), attached thereon.

Referring to FIGS. 4–7, the pick-up cap 3 is a substantially rectangular plate and comprises a body portion 30. A first and a second engaging ears 320, 321 are respectively formed on opposite lateral sides 32 of the body portion 30. A pair of claws 310 is formed on each lengthwise side 31 perpendicular to the lateral sides 32. The body portion 30 comprises a smooth upper surface 34 and an opposite lower surface 33. A plurality of ribs 35 protrudes downwardly from the lower surface 33 of the body portion 30 and each has a slot 36 recessed therein.

Figure 5:
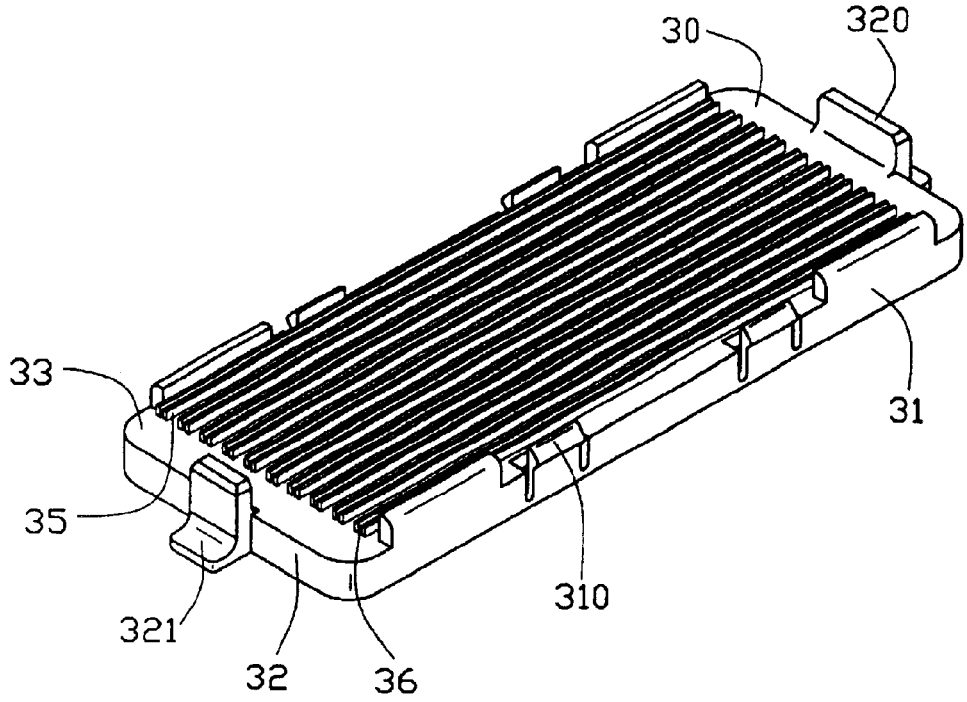
FIG. 5 is a view similar to FIG. 4, but taken from bottom and rear aspects.
Figure 6:
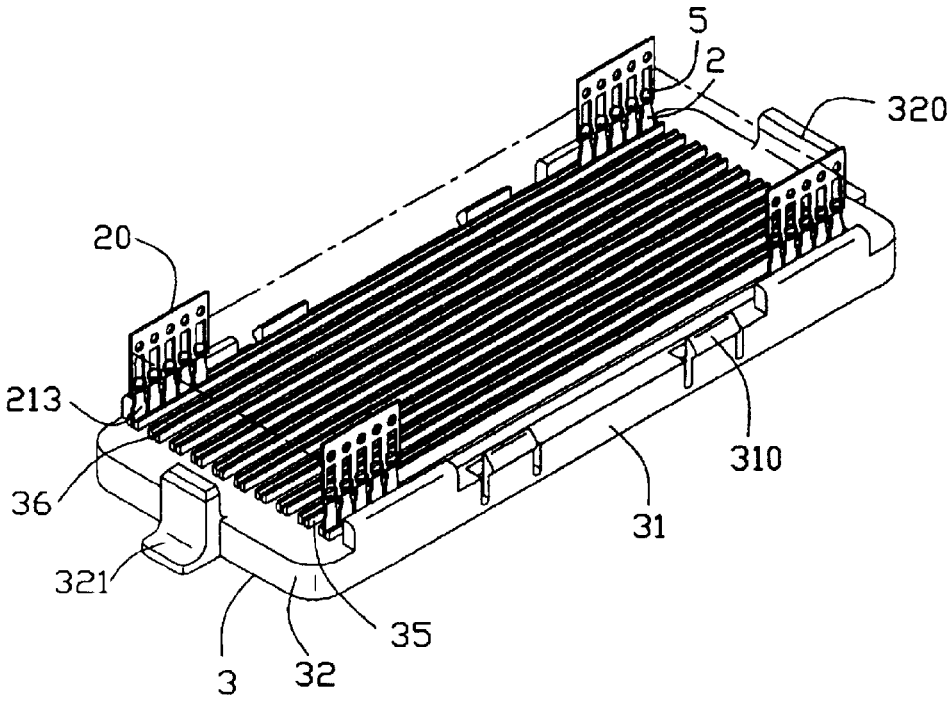
FIG. 6 is a perspective view illustrating a plurality of contacts with carriers thereon being assembled to the pick-up cap, with solder balls on the contacts being illustrated by broken lines.

Referring to FIGS. 6–10, in assembly, the contacts 2 with carriers 20 integrally formed therewith are assembled to the pick-up cap 3. Upper portions of the contacting portions 21 of the contacts 2 are respectively received in the slots 32 of the pick-up cap 3 and are gripped by the ribs 31. The carriers 20 are then cut away from the contacts 2 (referring to FIG. 7). The solder balls 5 are fused onto the solder pads 230 of the contacts 2. In an alternative embodiment, as shown in FIG. 5, the solder balls 5 can be fused onto the solder pads 230 before the carriers being cut away. The pick-up cap 3 with the contacts 2 are together preloaded to the insulative housing 4. At the time, the pick-up cap 3 with the contacts 2 are only placed on the housing 4. The shoulders 210 of the contacting portion 21 of each contact 2 abut against the steps 414 of a corresponding passage 41. The pick-up cap 3 is then pushed down toward the mounting surface 402 of the insulative housing 4 until the solder pads 230 are substantially coplanar with the mounting surface 402 (referring to FIG. 10). The shoulders 210 of the contacts 2 fit into the inner surfaces 410 of the passages 41. The first and the second engaging ears 320, 321 respectively engage with the first and the second polarizing tabs 430, 431. The claws 310 are respectively received in the recesses 420. Thus, the cap 3 engages with the insulative housing 4 reliably. A vacuum suction apparatus (not shown) engages, the pick-up cap 3 of the electrical connector assembly 1, and via suctioning the pick-up cap 3, places the electrical connector assembly 1 onto selected positions of a printed circuit board (not shown). The cap 3 will not be removed away from the insulative housing 4 until the contacts 2 are soldered to the printed circuit board.

The pick-up cap 3 in accordance with the present invention not only realizes its original function, but also functions as assembling the contacts 2 to the housing 4 instead of an additional tool. Thus, production efficiency is improved and manufacturing cost is decreased. In addition, the contacts 2 are secured by the pick-up cap 3 during being soldered to the printed circuit board, the contacts 2 have no possibility of moving between the insulative housing 4 and the cap 3. This assures the reliable electrical connection between the contacts 2 and the printed circuit board. It is understood that because the pick-up cap 3 reliably holds the contacts 2 in position on the printed circuit board during soldering, the contacts 2 and the housing 4 may be arranged in either the relatively fixing manner or the relatively floating manner without jeopardizing soldering.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly mountable on a printed circuit board, comprising:

an insulative housing;

a plurality of contacts received in the insulative housing, each contact comprising a contacting portion and a connecting portion adapted for being soldered to the printed circuit board; and a pick-up cap removably assembled to the insulative housing and retaining and positioning the contacts in the insulative housing; wherein the pick-up cap comprises a plurality of slots defined therein, and wherein the contacting portions of the contacts are received in the slots; wherein the pick-up cap comprises an upper surface and an opposite lower surface, the pick-up cap comprises a plurality of ribs formed on the lower surface, and wherein the slots are recessed in the ribs.

2. The electrical connector assembly as claimed in claim 1, wherein the contact comprises a retention portion connecting the contacting portion and the connecting portion thereof.

3. The electrical connector assembly as claimed in claim 2, wherein the connecting portion of the contact forms a solder pad to retain a solder ball.

4. The electrical connector assembly as claimed in claim 2, wherein the insulative housing comprises a mating surface and an opposite mounting surface, the housing defines a plurality of passages extending from the mating surface toward the mounting surface, and wherein the contacts are respectively received in the passages.

5. The electrical connector assembly as claimed in claim 2, wherein each passage of the insulative housing comprises a pair of opposite slots defined therein to form a pair of steps in a middle thereof, and wherein each contact comprises a pair of shoulders formed on the contacting portion thereof and engaged with the steps of the passage.

6. The electrical connector assembly as claimed in claim 3, wherein the solder pads of the contacts are substantially coplanar with the mounting surface of the insulative housing.

7. The electrical connector assembly as claimed in claim 1, wherein the insulative housing comprises a polarizing tab, and wherein the cap has an engaging ear engaging with the polarizing tab of the housing.

8. The electrical connector assembly as claimed in claim 7, wherein the insulative housing comprises a planar base and a periphery wall extending vertically from periphery of the base, and wherein the passages are defined in the base.

9. The electrical connector assembly as claimed in claim 8, wherein the periphery wall comprises a pair of longitudinal walls and a pair of lateral walls, and wherein the polarizing tab is formed on the lateral wall.

10. The electrical connector assembly as claimed in claim 9, wherein the pick-up cap is of a rectangular plate comprising a pair of lengthwise sides and a pair of lateral sides, each lengthwise side forms a claw thereof, and wherein each longitudinal wall defines a recess therein to receive the claw.

11. A method of assembling an electrical connector assembly, comprising the steps of:

providing an insulative housing comprising a mounting surface;

providing a pick-up cap;

providing a contact;

assembling the contact to the pick-up cap; and assembling the pick-up cap with the contact to the insulative housing; wherein the step of providing the pick-up cap comprises defining a slot therein, and wherein the contact comprises a contacting portion received in the slot and a connecting portion opposite to the contacting portion.

12. The method of assembling an electrical connector assembly as claimed in claim 11, wherein the step of providing the pick-up cap comprises forming a rib thereon, and wherein the slot is recessed in the rib.

13. The method of assembling an electrical connector assembly as claimed in claim 11, further comprising a step of fusing a solder ball onto the connecting portion of the contact before the step of preloading the pick-up cap with the contact to the insulative housing.

14. The method of assembling an electrical connector assembly as claimed in claim 11, further comprising a step of fusing a solder ball onto the connecting portion of the contact after the step of pressing the pick-up cap toward the mounting surface of the insulative housing.

15. The method of assembling an electrical connector assembly as claimed in claim 11, wherein the step of assembling the pick-up cap with the contact to the insulative housing comprises preloading the pick-up cap with the contact to the insulative housing and pressing the pick-up cap toward the mounting surface of the insulative housing until an end of the connecting portion of the contact is coplanar with the mounting surface of the insulative housing.

16. An electrical connector assembly comprising:

a printed circuit board;

an insulative housing located above the printed circuit board and defining a plurality of vertical passageways;

a pick-up cap detachably attached to a top portion of the housing and providing thereon an upward flat suction face facing away from the; and a plurality of contacts disposed in the corresponding passageways, respectively, each of said contacts including opposite upper and lower portions; wherein the pick-up cap reliably holds the upper portions of the contacts before and during soldering the lower portions of the contacts to the printed circuit board, and successively is removed from the housing, under a condition that the upper portions of the contacts are configured to prevent upward movement of the housing relative to the contacts after said pick-up cap is removed.

* * * * *